US005676584A

United States Patent [19]

Perryman

[11] Patent Number: 5,676,584

[45] Date of Patent: Oct. 14, 1997

[54] DOLL WITH INTERCHANGEABLE FACES

[76] Inventor: Joyce A. Perryman, P.O. Box 1201, Carthage, N.C. 28327

[21] Appl. No.: 721,196

[22] Filed: Sep. 27, 1996

[51] Int. Cl.[6] ..... A63H 3/12; A63H 3/08; A63H 3/02

[52] U.S. Cl. ..... 446/321; 446/98; 446/372; 446/391

[58] Field of Search ..... 446/98, 100, 321, 446/337, 369, 372, 385, 391, 394, 901

[56] References Cited

U.S. PATENT DOCUMENTS

| | | | |
|---|---|---|---|
| 1,070,553 | 8/1913 | Stevens | 446/372 |
| 1,307,218 | 6/1919 | Spencer | 446/369 |
| 1,926,139 | 9/1933 | Browne | 446/321 X |
| 2,968,104 | 1/1961 | Ito | 446/394 X |
| 3,866,350 | 2/1975 | Goldfarb et al. | 446/391 X |
| 3,889,414 | 6/1975 | Whetzel | 446/394 |
| 5,405,266 | 4/1995 | Frank et al. | 446/321 X |

FOREIGN PATENT DOCUMENTS

| | | | |
|---|---|---|---|
| 2559676 | 8/1985 | France | 446/321 |
| 2627398 | 8/1989 | France | 446/321 |
| 2013508 | 8/1979 | United Kingdom | 446/321 |

*Primary Examiner*—D. Neal Muir
*Attorney, Agent, or Firm*—Rhodes, Coats & Bennett, LLP

[57] ABSTRACT

A series of interchangeable faces is incorporated into a child's doll. The doll includes a plane and nondescript head portion extending from the main body of the doll. A series of head slip covers, with each head slip cover including a distinct facial expression, is slipped over the doll's head. Each head slip cover includes a back, crown, neck, and face panel, with the distinct facial expression formed on the face panel. The back panel includes an elongated slit to allow the head to be quickly and easily inserted into the head slip cover, and a fastener on opposite sides of the slit prevents the head slip cover from sliding off the doll's head. The doll is constructed of a polyester material held within an outer casing to allow the doll to be machine washed.

17 Claims, 4 Drawing Sheets

DOLL WITH INTERCHANGEABLE FACES

FIELD OF THE INVENTION

The present invention relates, generally, to children's toys and dolls and, more specifically, to a child's doll having a series of interchangeable faces.

BACKGROUND OF THE INVENTION

Toy manufacturers are striving to mimic human life by designing ever more sophisticated children's dolls. The children's toy market is filled with dolls that wink, blink, walk, talk, cry, and wet. A doll can be fed, a diaper can be changed, and a doll's hair can be cut. Such dolls are designed to offer children realistic caregiver experiences.

Dolls with interchangeable faces have been the subject of past design efforts to create a doll with more lifelike features and, also, allow the doll to reflect a child's inner emotions. The child could change the doll's facial expression to reflect the child's own mood, or, the doll could be used to determine the child's emotional needs or emotional state. A doll with interchangeable facial expressions could also function as a telltale playmate.

The toy market lacks, though, a doll design that allows the child to simply and quickly exchange the facial expressions of the doll. A doll design is needed that allows children to quickly use their own hands to alter the doll's facial expression. A design is also needed that allows the child to choose from multiple and distinct facial expressions. For the foregoing reasons, a need presently exists for a child's doll that allows the child to simply and quickly exchange the facial expressions of the doll.

SUMMARY AND OBJECTS OF THE INVENTION

The present invention relates to a child's doll having a series of interchangeable faces to permit the child to simply and quickly change the facial expressions of the doll. The doll comprises a main body having arms, legs, and a plane and nondescript head portion extending from the main body. A series of head slip covers is provided, wherein each head slip cover is designed to pull over the head portion of the doll. Each head slip cover includes a facial area having a distinct facial expression inscribed, printed, or formed on the head slip cover. The concept and design of the head slip cover allows the child to quickly and easily exchange the facial expression of the doll. Each head slip cover includes a back, crown, face, and neck panels. The crown panel extends between the face and back panels, and the neck panel depends downward from the face panel and connects to the crown panel. The back panel includes an openable and closeable slit to allow the child to easily and quickly change the doll's facial expression. Each head slip cover can include a fastener, such as a hook and loop, to secure the head slip cover.

The doll is constructed of a material to allow the doll to be machine washed. The main body, arms, legs, and head portion are made from a polyester material held within a blended cotton and polyester outer casing. The head portion could, though, be injection molded using a thermoplastic polymer compound. A slip cover is removed by pulling the head portion through the slip cover opening. A child chooses a slip cover having the desired facial expression formed thereon. The child inserts the doll's head portion through the opening of the desired slip cover, and the child orients the slip cover so that the facial expression coincides with the plane and nondescript head portion.

It is, therefore, an object of the present invention to provide a child's doll that allows the child to simply exchange the facial expression of the doll by choosing the head slip cover having the desired facial expression formed on the face panel. Another object of the present invention is to provide a child's doll that allows the child to quickly exchange the facial expression of the doll by removing a head slip cover from the head portion and inserting a head slip cover with the desired facial expression.

Another object of the present invention is to provide a child's doll having various interchangeable facial expressions by forming distinct facial expressions on head slip covers that pull over the doll's head portion.

Other objects and advantages of the present invention will become apparent and obvious from a study of the following description and the accompanying drawings which are merely illustrative of such invention.

DETAILED DESCRIPTION OF THE INVENTION

Figure 1:
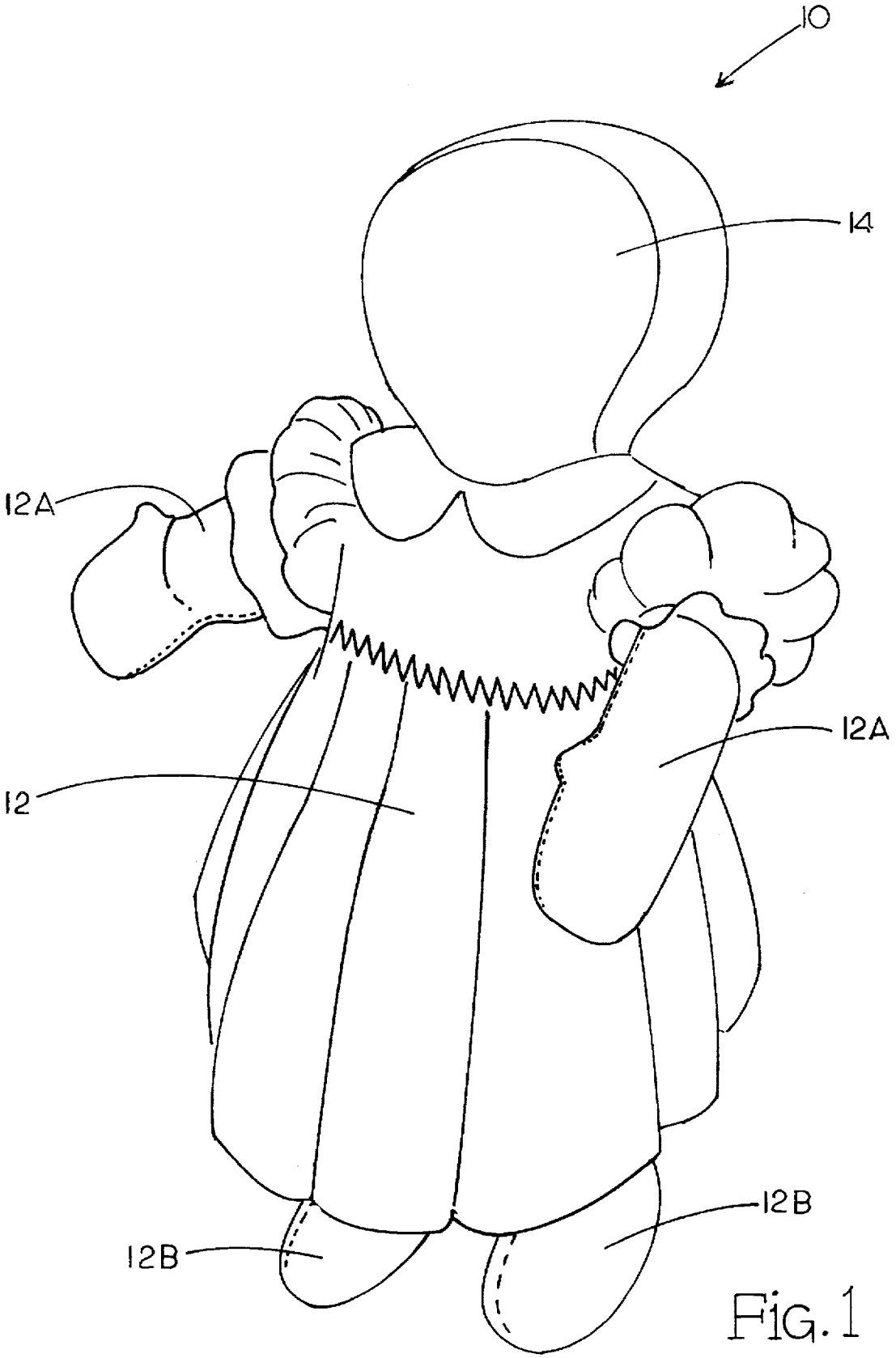
FIG. 1 is a perspective view of the doll of the present invention.
Figure 2:
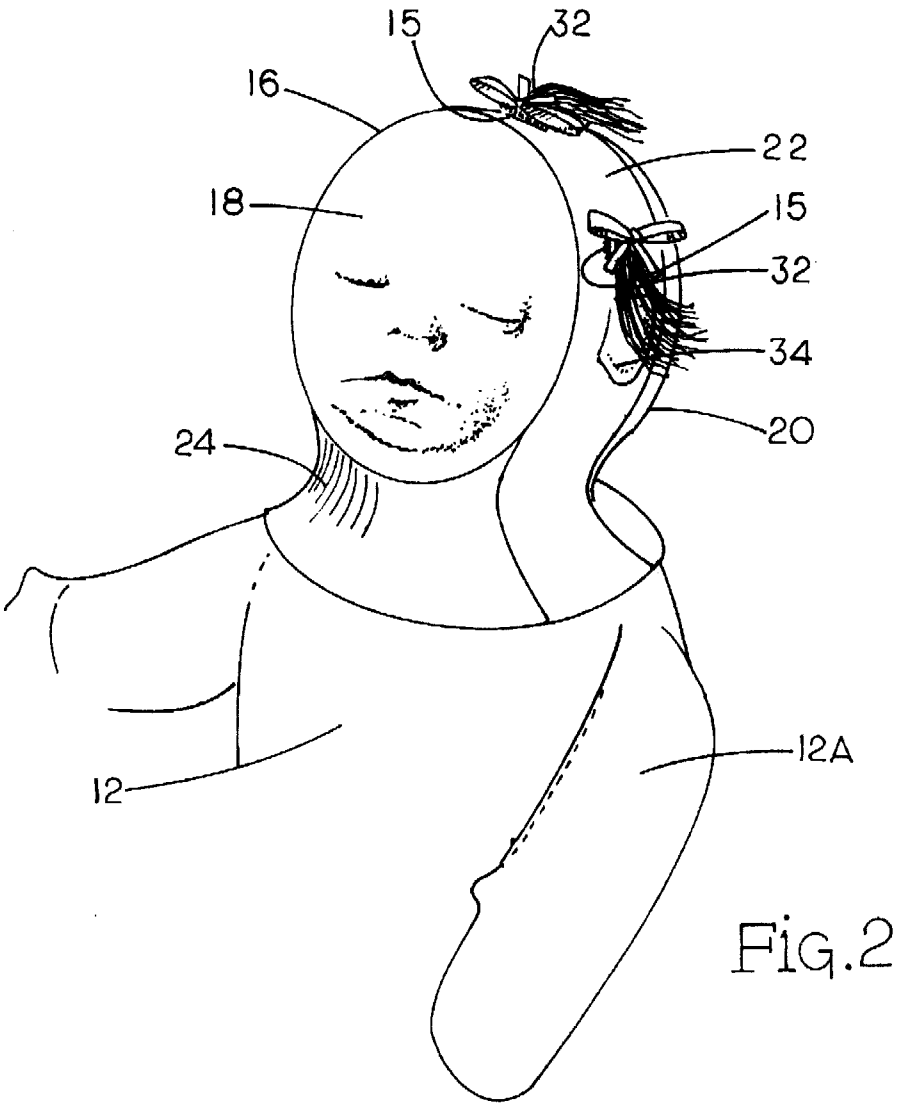
FIG. 2 is a view that illustrates a head slip cover being secured on the head of the doll.
Figure 4:
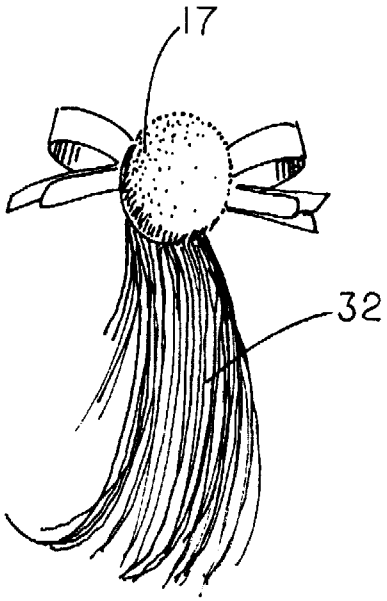
FIG. 4 is a perspective view of a hair piece that is designed to be attached to the head slip cover.
Figure 3:
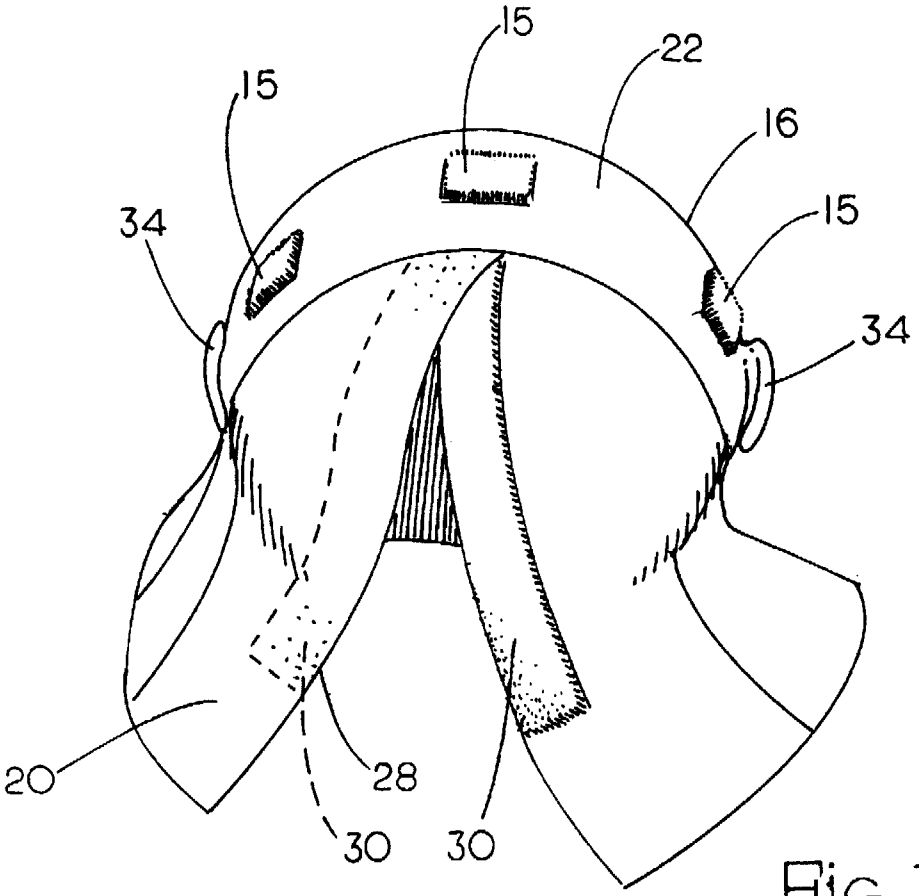
FIG. 3 is a perspective view of the head slip cover viewed from the back and shown open.

With reference to the drawings, the doll of the present invention is shown therein and indicated generally by the numeral 10. Doll 10 includes a main body 12, arms 12A and legs 12B extending from and attaching to main body 12, and a plane and nondescript head portion 14. "Nondescript" as used herein means the head portion is devoid of the human features usually found in other doll designs such as a nose, a mouth, eyes, ears, and other facial features.

The doll includes a series of head slip covers indicated generally by the numeral 16. Each slip cover includes face panel 18, back panel 20, crown panel 22, and neck panel 24. Crown panel 22 stretches left to right and around head 14. Face panel 18 depends from crown panel 22. Neck panel 24 depends downward from face panel 18 and is connected to the crown panel 22. Defined about the lower portion of the slip cover is an opening. This opening is formed about the base of the slip cover 16 when the same is closed and allows the neck portion of the doll to project therethrough when the head 14 is covered by the slip cover 16. Each slip cover is designed to be secured and removed from the head. Back panel 20 includes an elongated slit 28 to quickly remove the slip cover from the head. Slit 28 is openable and closeable using hook and loop fasteners 30 disposed on opposite sides of the slit or, alternately, by other fasteners such as snap fasteners.

Figures 5, 6, 7:
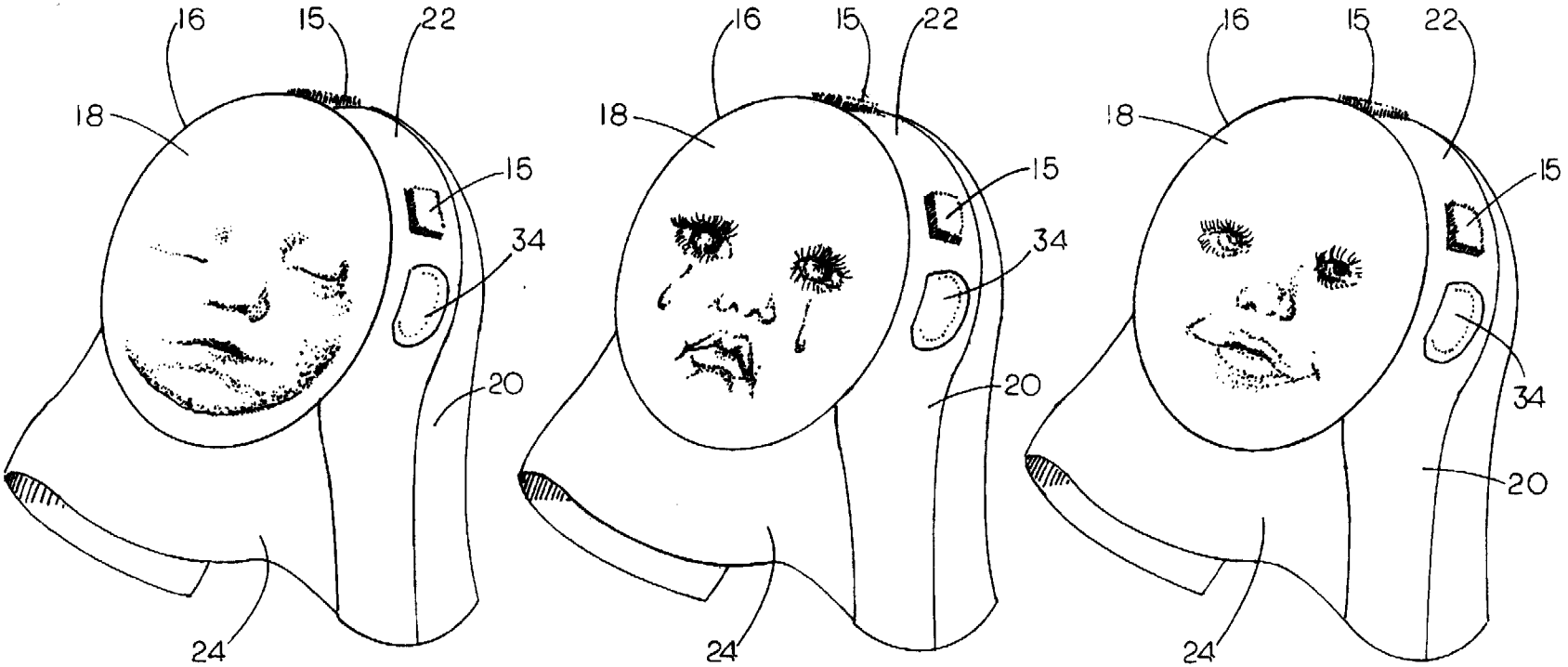
FIGS. 5, 6 and 7 are a sequence of views showing various facial expressions imprinted on the head slip cover.

Each face panel 18 includes a distinct facial expression formed thereon. Three contemplated facial expressions include a happy expression (FIG. 7), a sad or crying expression (FIG. 6, and a sleepy expression (FIG. 5). Though only three facial expressions are disclosed, it is understood the face panel could include many other facial expressions.

Each head slip cover 16 can include a plurality of ears 34 and hairpieces 32. Ears 34 are attached to the slip cover. A series of independent hairpieces 32 can be detachably secured to slip cover 16 by hook and loop fasteners. In order to attach the hairpieces 32 to the slip covers 16, each slip cover is provided with a series of hook and loop fastener pads 15 that are disposed on the crown 22 of the slip cover. Also, each hairpiece 32 includes a hook and loop fastener pad 17 for attaching to the hook and loop fastener pads 15 on the slip covers 16.

Doll 10 can be constructed of various materials. An added feature of the present invention would be the ability to machine wash the doll. It is contemplated the main body, arms, legs, and head will be made from a polyester material held within a blended cotton and polyester fabric casing. Head 14 could be injection molded using a thermoplastic polymer compound.

It is contemplated the doll will be packaged with two documents: the first document would be a poem or verse concerning the doll or some aspect of the doll; the second document would be a "Certificate of Placement" between the child and the parents of the child. The Certificate of Placement would be completed by the child's parents to give the doll identity and family lineage.

The method of changing the doll's facial expression will now be discussed. The child grasps back panel 20 and opens the fasteners 30. The slip cover is removed by pulling head portion 14 through the slip cover opening 26. The child chooses a slip cover with the desired facial expression formed on the slip cover. The child inserts the doll's head through opening 26 of the desired slip cover, and the child orients the face panel 18 on the plane and nondescript head portion 14. The child grasps back panel 20 and aligns fasteners 30 located on opposite sides of slit 28. The child secures the desired head slip cover by closing the fastener. The child can then add a series of hairpieces 32 to further compliment, enhance, or contrast the doll's facial expression.

The present invention is designed to allow children to very simply exchange the doll's facial expression. A series of head slip covers are provided with a distinct facial expression formed on each slip cover. The developing child need only remove a slip cover, choose a slip cover with the facial expression desired, and slip the desired cover over the doll's head. No manipulation of the doll's face is required.

The present invention is, also, designed to provide the doll with a variety of facial expressions. Since the invention uses head slip covers, multiple and distinct facial expressions can be provided. Each slip cover can have a distinct facial expression formed on the slip cover. Slip covers can be designed to include many other expressions than those disclosed herein.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A doll having interchangeable faces, comprising: a main body including arms and legs; a plane and nondescript head portion extending from the main body; a series of head slip covers with each head slip cover including an open bottom such that the entire head slip cover can be pulled over the head portion of the doll; each head slip covering including a face portion, a back portion, and a lower surrounding terminal edge; an elongated slit formed in the back portion of the head cover and extending through the lower terminal edge of the head cover and extending upwardly therefrom a substantial distance along the back portion of the head cover so as to divide the back portion of the head cover into two panels; cooperative fasteners formed on the head cover on opposite sides of the slit for securely closing the slit and securing the head cover about the head portion of the doll and wherein the face portion of each head slip cover includes a facial area having a distinct facial expression formed thereon.

2. The doll of claim 1 wherein the main body, arms, and legs are made from a polyester material held within a blended cotton and polyester outer casing to allow the doll to be machine washed.

3. The doll of claim 1 wherein the head portion is made from a polyester material held within a blended cotton and polyester outer casing to allow the doll to be machine washed.

4. The doll of claim 1 wherein the head portion is made from a thermoplastic polymer.

5. The doll of claim 1 wherein the head cover includes a crown panel that extends between the face and back portions.

6. The doll of claim 5 wherein the head slip cover includes a neck panel depending downward from the face portion and connecting with the crown panel.

7. The doll of claim 5 wherein the doll includes a series of independent hair pieces detachably secured to the head slip cover.

8. The doll of claim 5 wherein the doll further includes a left and a right ear secured to the head slip cover.

9. A doll having interchangeable faces, comprising: a main body including arms and legs; a plane and nondescript head portion extending from the main body; a series of head slip covers with each head slip cover including an open bottom such that the entire head slip cover can be pulled over the head portion of the doll; the head cover including a back panel with an openable and closeable slit formed therein; hook and loop fasteners formed along opposite sides of the slit; and wherein the face portion of each head slip cover includes a facial area having a distinct facial expression formed thereon.

10. The doll of claim 9 wherein the doll further includes a series of independent hair pieces detachably secured to the head slip cover.

11. The doll of claim 9 wherein the head slip cover includes a face portion, a crown panel, and a neck panel depending downwardly from the face portion.

12. The doll of claim 11 wherein the doll further includes a series of independent hair pieces detachably secured to the crown panel.

13. The doll of claim 11 wherein each crown panel includes a left and a right ear.

14. The doll of claim 9 wherein each head slip cover includes a left and a right ear.

15. The doll of claim 9 wherein the main body, arms, and legs are made from a polyester material held within a blended cotton and polyester outer casing to allow the doll to be machine washed.

16. The doll of claim 9 wherein the head portion is made from a polyester material held within a blended cotton and polyester outer casing to allow the doll to be machine washed.

17. The doll of claim 9 wherein the head portion is made from a thermoplastic polymer.

* * * * *